US008077129B2

(12) United States Patent
Su et al.

(10) Patent No.: US 8,077,129 B2
(45) Date of Patent: Dec. 13, 2011

(54) PIXEL STRUCTURE AND METHOD FOR GENERATING DRIVE VOLTAGES IN THE SAME

(75) Inventors: Ting-Wei Su, Hsinchu (TW); Jenn-Jia Su, Hsinchu (TW)

(73) Assignee: Au Optronics Corp., Hsinchu (TW)

( * ) Notice: Subject to any disclaimer, the term of this patent is extended or adjusted under 35 U.S.C. 154(b) by 766 days.

(21) Appl. No.: 11/748,547

(22) Filed: May 15, 2007

(65) Prior Publication Data

US 2008/0174537 A1 Jul. 24, 2008

(30) Foreign Application Priority Data

Jan. 24, 2007 (TW) ..... 96102741 A

(51) Int. Cl.
*G09G 3/36* (2006.01)

(52) U.S. Cl. ..... 345/96; 345/94; 345/208; 349/143

(58) Field of Classification Search ..... 345/76–83, 345/87–102, 204–208, 690–699; 315/169.1, 315/169.3; 349/56, 84, 139, 143
See application file for complete search history.

(56) References Cited

U.S. PATENT DOCUMENTS

| | | | | |
|---|---|---|---|---|
| 7,589,703 | B2 * | 9/2009 | Su | 345/87 |
| 2003/0227429 | A1 | 12/2003 | Shimoshikiryo | |
| 2004/0001167 | A1 | 1/2004 | Takeuchi et al. | |
| 2005/0122441 | A1 | 6/2005 | Shimoshikiryoh | |
| 2005/0213015 | A1 | 9/2005 | Shimoshikiryo | |
| 2006/0097972 | A1 | 5/2006 | Takeuchi et al. | |
| 2006/0284811 | A1 * | 12/2006 | Huang | 345/92 |
| 2007/0176874 | A1 * | 8/2007 | Yeh | 345/92 |
| 2007/0263144 | A1 * | 11/2007 | Lin et al. | 349/114 |

OTHER PUBLICATIONS

Taiwan Office Action mailed Aug. 30, 2011.
English translation (by machine) of Taiwan Office Action mailed Aug. 30, 2011.

* cited by examiner

*Primary Examiner* — Stephen Sherman
(74) *Attorney, Agent, or Firm* — Thomas, Kayden, Horstemeyer & Risley, LLP

(57) ABSTRACT

A pixel structure and a method for generating drive voltages in the pixel structure are disclosed. The pixel structure comprises a first sub-pixel electrode, a first com-line, and second com-line. The first sub-pixel electrode is applied with a first drive voltage. The first com-line transmits a first com-voltage signal. The second com-line transmits a second com-voltage signal. The first drive voltage is derived by combining the first com-voltage signal and the second com-voltage signal.

8 Claims, 5 Drawing Sheets

PIXEL STRUCTURE AND METHOD FOR GENERATING DRIVE VOLTAGES IN THE SAME

This application claims the benefit of priority based on Taiwan Patent Application No. 096102741 filed on Jan. 24, 2007, the disclosures of which are incorporated herein by reference in their entirety.

BACKGROUND OF THE INVENTION

1. Field of the Invention

The present invention relates to a pixel structure and a method for generating drive voltages in the pixel structure; more specifically, the present invention relates to a pixel structure and a method for generating drive voltages according to com-voltage signals in the pixel structure.

2. Descriptions of the Related Art

In recent years, flat panel displays (FPDs) have developed rapidly and gradually replaced traditional cathode radiation tube displays. Today, major flat panel displays include: organic light-emitting diodes displays (OLEDs), plasma display panels (PDPs), liquid crystal displays (LCDs), and field emission displays (FEDs). Each of these FPDs is composed of many pixels, each of which is a key component of the FPD.

An LCD is one kind of the FPDs that has high resolution, small size, and low power consumption. Furthermore, the LCD has better performance, higher productivity, and lower prices compared to the other FPDs. As a result, the market sale of LCD has increased.

In a conventional LCD, each pixel needs a drive voltage for providing an electric field for liquid crystal reorientation in the pixel, such that the LCD can display a frame with different brightness and contrast on different pixels. Because of the single drive voltage applied to each pixel in the conventional LCD, the color will be inversed at a large visual angle and degrade display performance. Furthermore, in conventional twisted nematic liquid crystal displays (TN LCDs), there are problematic gray level inversions caused by the over-changing of the visual angle. In general, for LCDs, a higher gray level in a pixel indicates a higher level of brightness in the pixel. For example, a pixel with a gray level 0 displays black, while one with a gray level 255 displays white. However, when viewing the TN LCD at a large visual angle, pixels of the lower gray level display higher brightness than those of the higher gray level. Hence, the user views the display with black-white inversion, also known as gray level inversions.

To reduce the above drawbacks, some systems and methods capable of driving different sub-pixels using different drive voltages within a signal pixel have been developed. Multiple drive voltages are required in each of the pixels to drive different sub-pixels. Therefore, multiple com-lines are needed in each pixel for transmitting the multiple drive voltages. In other words, when there are two drive voltages required for driving two sub-pixels in a pixel, two com-lines are fabricated for the pixel. When there are three drive voltages required for driving three sub-pixels in a pixel, three com-lines are fabricated for that pixel. The more numbers of drive voltages required within a pixel for driving multiple sub-pixels, the more corresponding com-lines needed.

As shown in FIG. 1, a conventional pixel structure 1 of the LCD of the prior art comprises a first sub-pixel area 101, a second sub-pixel area 103, a third sub-pixel area 105, a first com-line 107, a second com-line 109, a third com-line 111, gate lines 113*a* and 113*b*, thin-film transistors (TFTs) 115, 117 and 119, and data lines 121*a* and 121*b*. The on/off state of the TFT 115 and the operation of the first sub-pixel area 101 are controlled by a gate voltage transmitted by the gate line 113*a*. The on/off state of the TFT 117 and the operation of the second sub-pixel area 103 are also controlled by the gate voltage transmitted by the gate line 113*a*. Moreover, the on/off state of the TFT 119 and the third sub-pixel area 105 are controlled by the gate voltage transmitted by the gate line 113*a*. The data line 121*a* transmits drive voltages required by the first sub-pixel area 101, the second sub-pixel area 103 and the third sub-pixel area 105 via the TFTs 115, 117 and 119, respectively. The first com-line 107 is configured to transmit the drive voltage required by the first sub-pixel area 101, while the second com-line 109 is configured to transmit the drive voltage required by the second sub-pixel area 103. Similarly, the third com-line 111 is configured to transmit the drive voltage required by the third sub-pixel area 105.

FIG. 2 is a schematic diagram illustrating voltage waveforms in the conventional pixel structure, which includes: voltage waveforms of the first sub-pixel area 101, the second sub-pixel area 103, the third sub-pixel area 105, the first com-line 107, the second com-line 109, the third com-line 111, and the gate line 113. In FIGS. 1 and 2, there are three com-lines 107, 109, and 111 required for transmitting three different drive voltages to the sub-pixel areas 101, 103, and 105.

Even though providing multiple drive voltages through multiple com-lines in a single pixel of the prior art may reduce color washout and gray level inversion at large visual angles, the increased number of com-lines results in an increased metal area. As a result, the aperture ratio of the pixels is decreased. Moreover, the increased in com-line signals also increases the complexity and cost of the pixels' peripheral wiring.

Thus, it is important to find a method for decreasing the number of com-lines to increase aperture ratio of the pixel and to reduce the complexity and cost of wiring while preserving the benefits of having multiple drive voltages.

SUMMARY OF THE INVENTION

An objective of this invention is to provide a pixel structure, which comprises a first sub-pixel electrode, a first com-line, and a second com-line. The first sub-pixel electrode is applied with a first drive voltage. The first com-line is configured to transmit the first com-voltage signal. The second com-line is configured to transmit a second com-voltage signal. The first drive voltage is derived from both of the first com-voltage signal and the second com-voltage signal.

Another objective of this invention is to provide a method for generating drive voltages in a pixel structure. The method comprises the following steps of: generating a first com-voltage signal; generating a SECOND com-voltage signal; and deriving a first drive voltage from the first com-voltage signal and the second com-voltage signal.

Yet a further objective of this invention is to provide a pixel structure, which comprises a first com-line, a second com-line, a first sub-pixel electrode, a second sub-pixel electrode, and a third sub-pixel electrode. The first com-line is configured to transmit a first com-voltage signal. The second com-line is configured to transmit a second com-voltage signal. The first drive voltage is applied to the first sub-pixel electrode, wherein the first drive voltage is derived from the first com-voltage signal and the second com-voltage signal. The second drive voltage is applied to the second sub-pixel electrode, wherein the second drive voltage is derived from the first com-voltage signal. The third drive voltage is applied to the third sub-pixel electrode, wherein the third drive voltage is derived from the second com-voltage signal.

The present invention uses com-lines to derive a larger number of drive voltages compared to the adopted the numbers of com-lines. As a result, the complexity and cost of peripheral wiring, as well as the size of the pixel structure and circuit design is effectively decreased. The problematic gray level inversions due to large visual angles in conventional LCDs are thereby, avoided.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
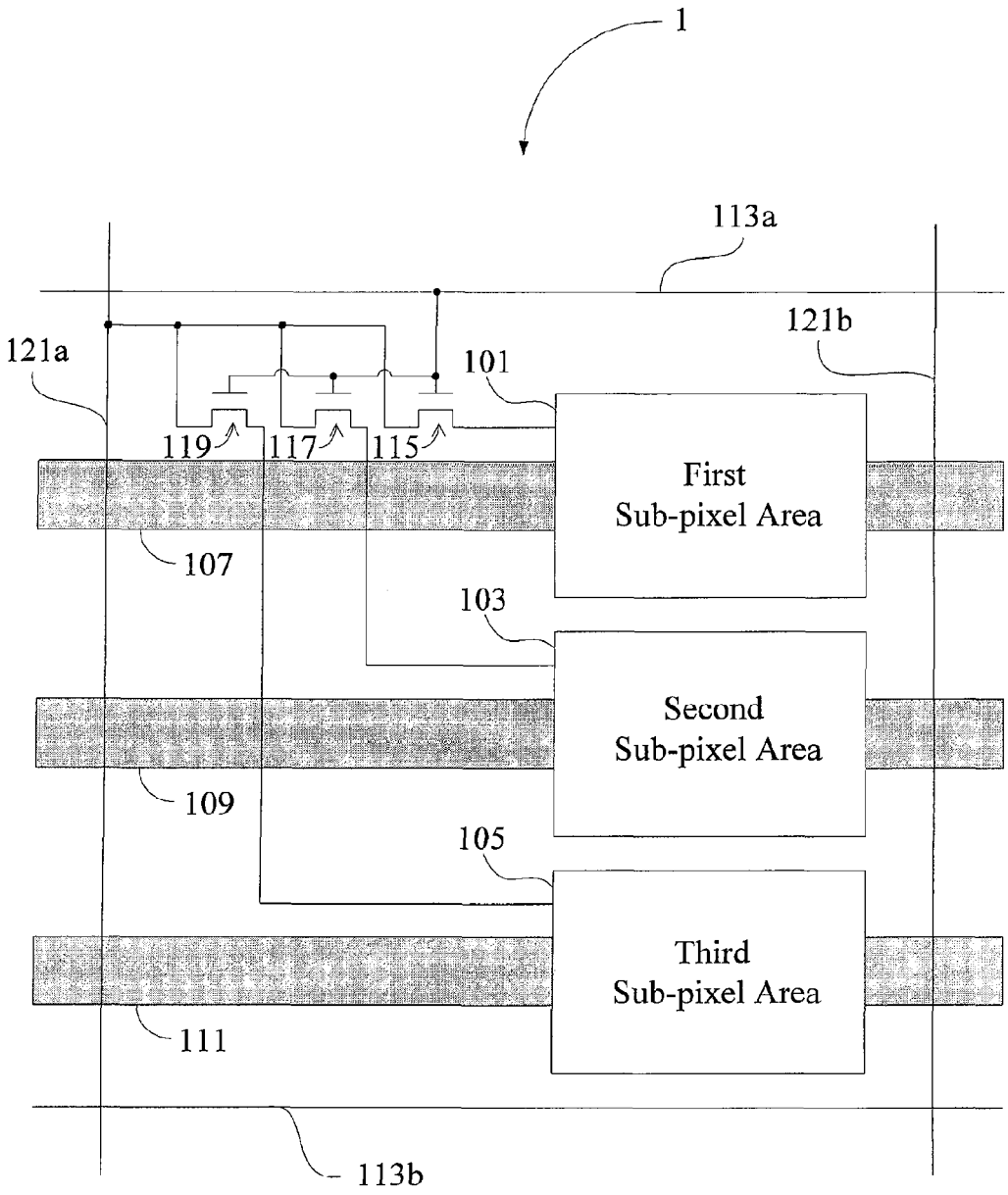
FIG. 1 (Prior Art)
FIG. 1 is a schematic diagram of a pixel structure of the prior art.
Figure 2:
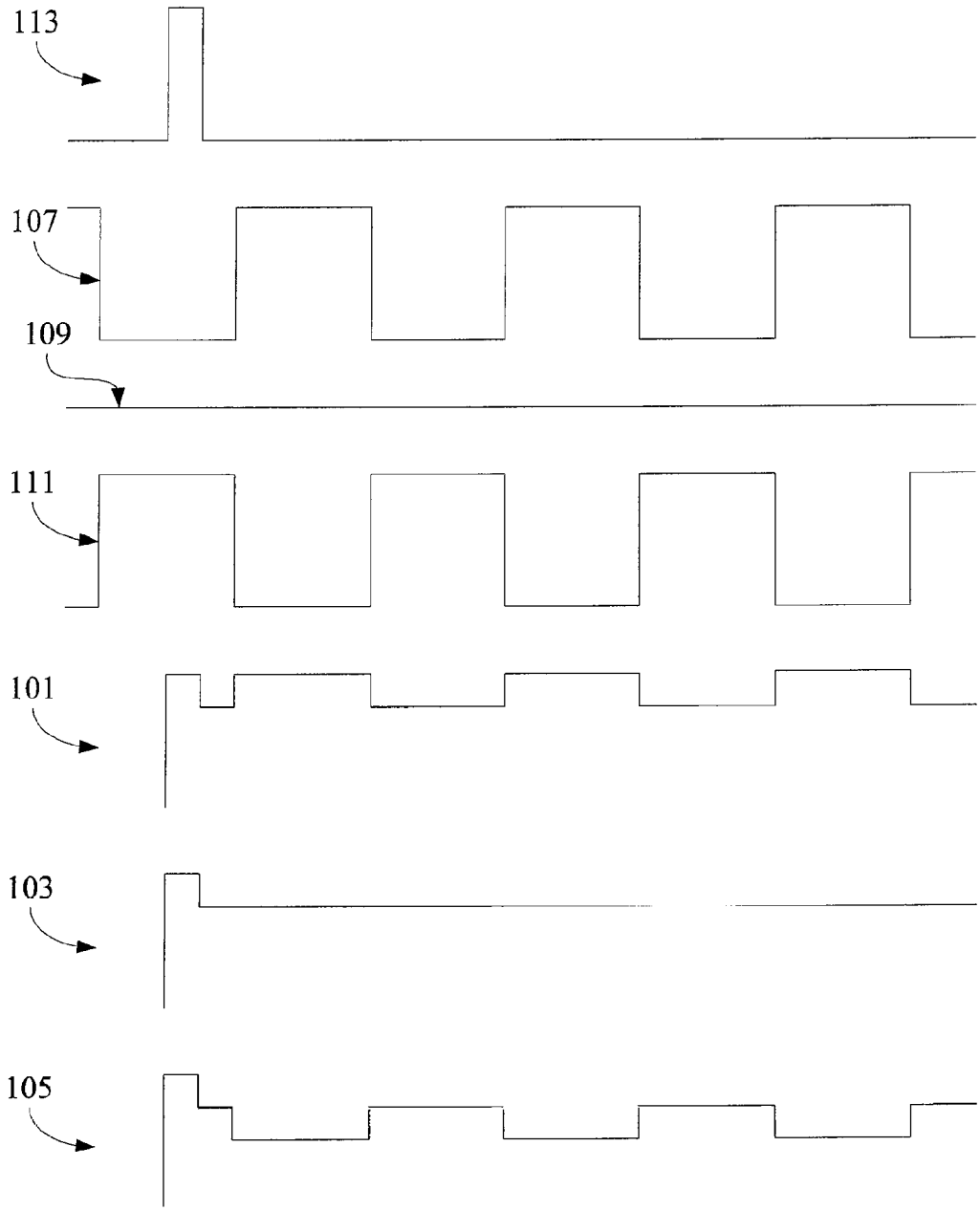
FIG. 2 (Prior Art)
FIG. 2 is a schematic diagram illustrating voltage waveforms in the pixel structure of the prior art.
Figure 3:
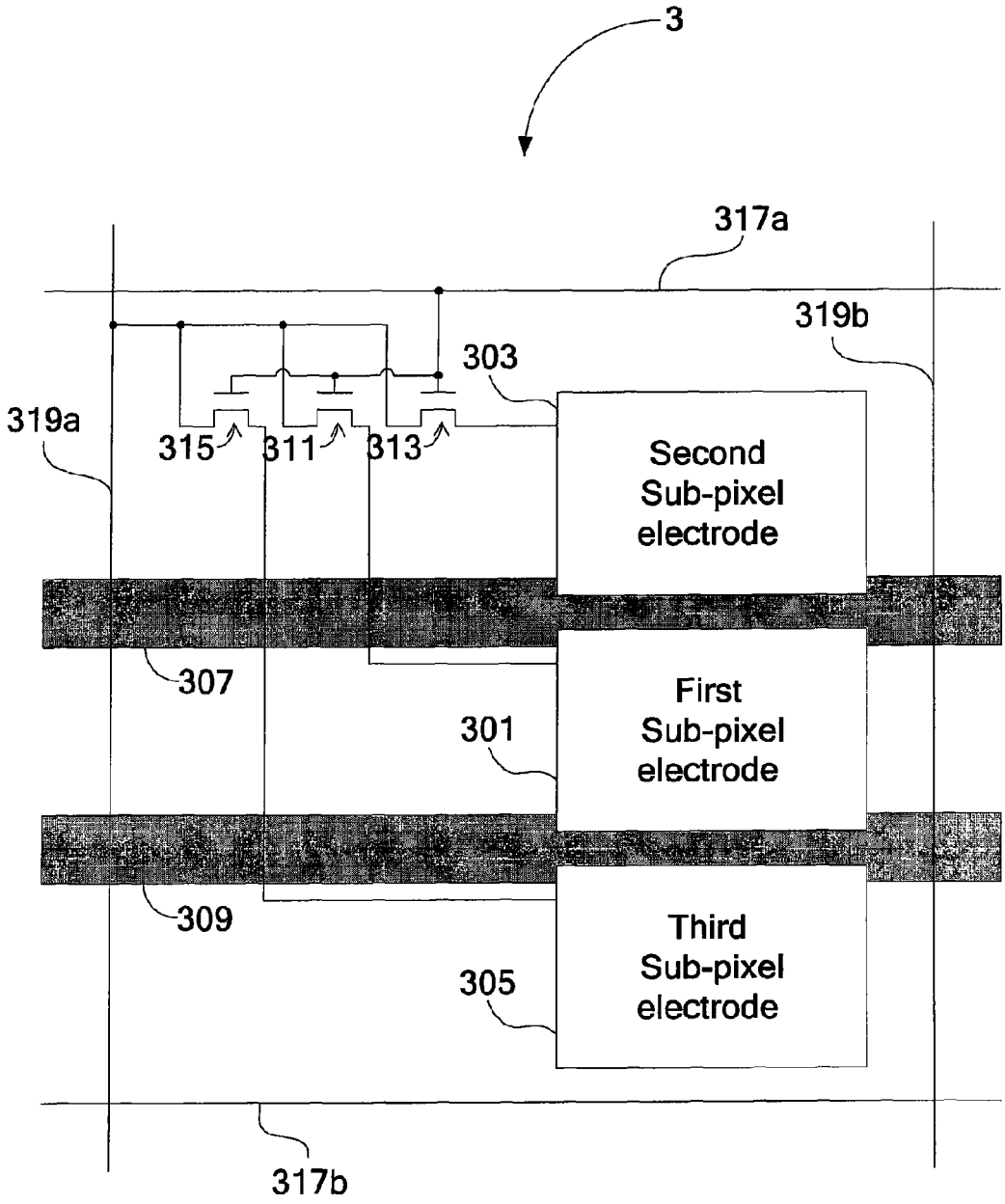
FIG. 3 is a schematic diagram illustrating a preferred embodiment of the present invention.

As shown in FIG. 3, a pixel structure 3 of a preferred embodiment of the present invention is illustrated. The pixel structure 3 may be applied in an LCD or another kind of FPD. The pixel structure 3 comprises a first sub-pixel electrode 301, a second sub-pixel electrode 303, a third sub-pixel electrode 305, a first com-line 307, a second com-line 309, a first TFT 311, a second TFT 313, a third TFT 315, gate lines 317*a* and 317*b*, and data lines 319*a* and 319*b*. The TFT 311 is electrically connected to the first sub-pixel electrode 301, and controls the operation of the first sub-pixel electrode 301 in coordination with the gate line 317*a*. That is, when a gate voltage is transmitted by the gate line 317*a* for the first TFT 311, the gate voltage transmitted by the gate line 317*a* may control the operation of the first sub-pixel electrode 301 via the first TFT 311. Similarly, the second TFT 313 that is electrically connected to the second sub-pixel electrode 303 controls the operation of the second sub-pixel electrode 303 in coordination with the gate voltage transmitted by the gate line 317*a*. Likewise, the third TFT 315 that is electrically connected to the third sub-pixel electrode 305 controls the operation of the third sub-pixel electrode 305 in coordination with the gate voltage transmitted by the gate line 317*a*.

Figure 4:
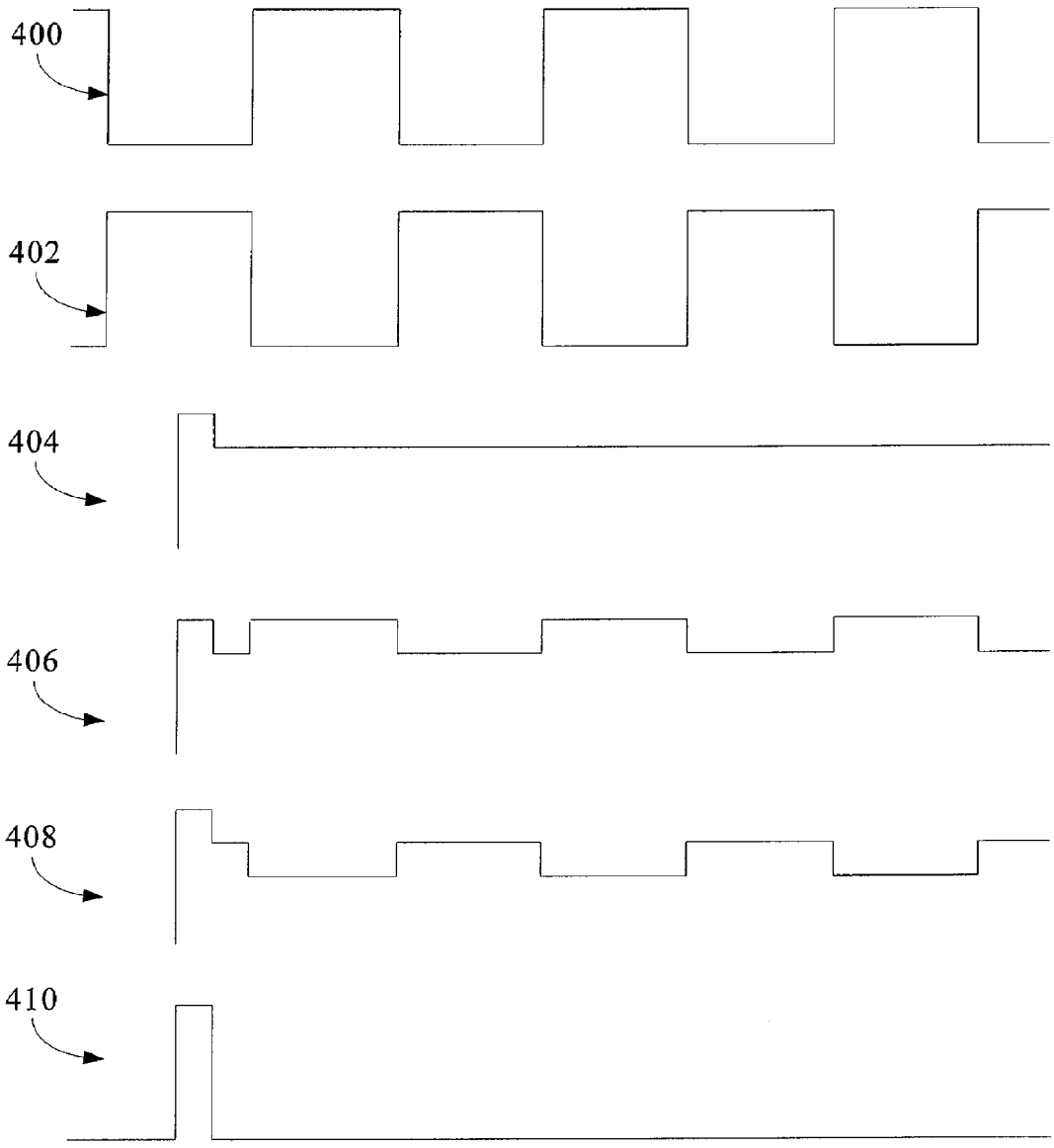
FIG. 4 is a schematic diagram illustrating voltage waveforms of the preferred embodiment of the present invention.

FIG. 4 is a schematic diagram illustrating voltage waveforms in the pixel structure 3 according to the preferred embodiment of the present invention, which comprises voltage waveforms of the first sub-pixel electrode 301, the second sub-pixel electrode 303, the third sub-pixel electrode 305, the first com-line 307, the second com-line 309, and the gate line 317*a* described above. The first com-line 307 is configured to transmit a first com-voltage signal 400. The second com-line 309 is configured to transmit a second com-voltage signal 402. In the present embodiment, both the first com-voltage signal 400 and the second corn voltage signal 402 are variable in every duty cycle. Furthermore, according to the driving requirement of the pixel, either the amplitudes of the two voltage signals may be substantially different, or the phases of the two voltage signals may be substantially different.

In the preferred embodiment mentioned above, the first drive voltage 404 used for the first sub-pixel electrode 301 is derived from the combination of the first com-voltage signal 400 and the second com-voltage signal 402, as well as the voltage adjustment transmitted by the data line 319*a*. In more detail, the first com-voltage signal 400 and the second com-voltage signal 402 are added up so that the variation of the pulses between the two voltage signals may cancel out. The cancellation occurs because the first com-voltage signal 400 and the second com-voltage signal 402 are complementary to each other, allowing for the voltage transmitted by the data line 319*a* to be further adjusted, such that the first drive voltage 404 with fixed and stable amplitude is derived. The second drive voltage 406 used for the second sub-pixel electrode 303 is derived according to the voltage transmitted by the data line 319*a*, which is adjusted by the first com-voltage signal 400. As shown in FIG. 4, the variation of pulses in the second drive voltage 406 and the variation of pulses in the first com-voltage signal 400 are synchronous. Likewise, the third drive voltage 408 required by the third sub-pixel electrode 305 is derived according to the voltage transmitted by data line 319*a*, which is adjusted by the second com-voltage signal 402. As shown in FIG. 4, the variation of pulses in the third drive voltage 408 and the variation of pulses in the second com-voltage signal 402 are synchronous as well. Accordingly, three different drive voltage signals are derived from only two com-voltage signals. There can be even more than three drive voltage signals derived if the ratio of the two com-voltage signals for summing or subtracting is adjusted. Furthermore, the gate line 317*a* transmits the gate voltage 410 to turn on or off the first sub-pixel electrode 301, the second sub-pixel electrode 303, and the third sub-pixel electrode 305 of the pixel structure 3.

Figure 5:
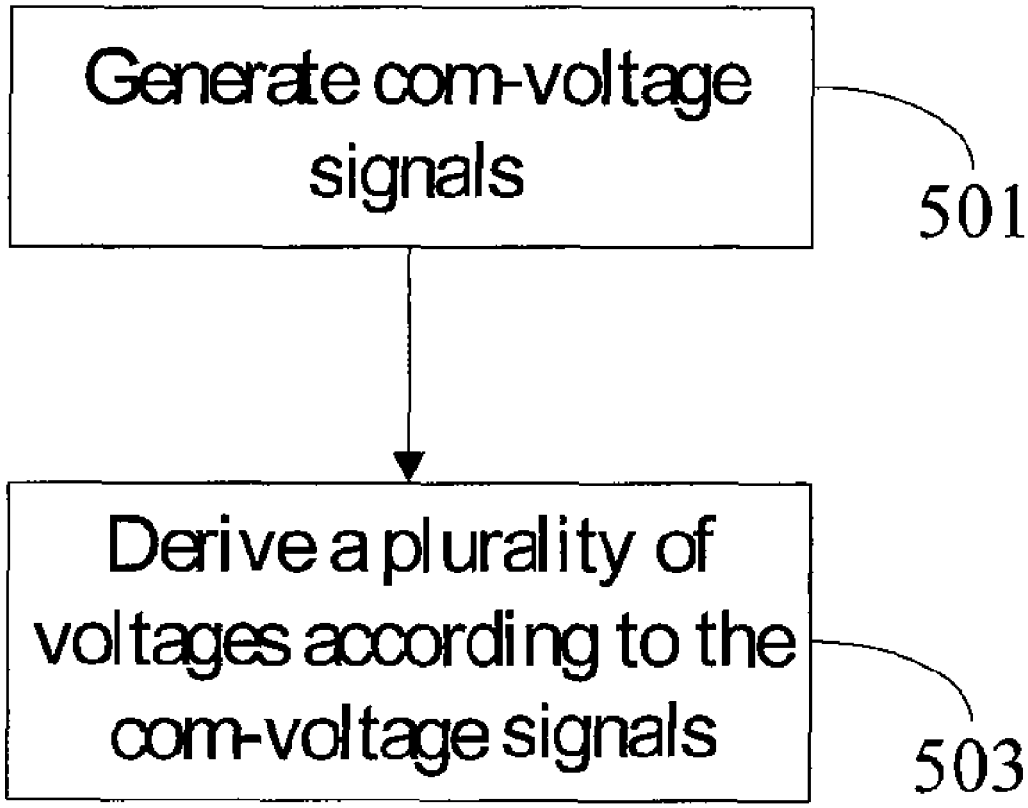
FIG. 5 is a flowchart illustrating a method of the preferred embodiment of the present invention.

FIG. 5 illustrates a method for generating drive voltages in a pixel of a pixel structure 3 in the aforementioned preferred embodiment. The method is described as follows.

In step 501, com-voltage signals are generated. According to the present invention, the com-voltage signals comprise a first com-voltage signal and a second com-voltage signal as mentioned in the preferred embodiment mentioned above. In step 503, a plurality of drive voltages are derived according to the com-voltage signals. According to the present invention, the drive voltages comprise the first drive voltage, the second drive voltage, and the third drive voltage.

Accordingly, compared to the pixel structure and method for generating multiple drive voltages in a single pixel of the prior art, the pixel structure and related method described by the present invention provide a larger number of drive voltages compared to the number of adopted com-lines. Therefore, the aperture ratio of the pixels may be increased, the complexity and cost of peripheral wiring may be decreased, as well as the size of the pixel structure and the circuit design may be effectively decreased. Furthermore, problematic gray level inversions due to large visual angles in prior LCDs can be avoided.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A method for generating drive voltages in a pixel structure, comprising the steps of;

generating a first com-voltage signal transmitted by a first com-line;

generating a second com-voltage signal transmitted by a second com-line;

deriving a first drive voltage, for a first sub-pixel electrode electrically connected to the first com-line and the second com-line, according to the first com-voltage signal, the second com-voltage signal and a voltage adjustment transmitted by a data line;

deriving a second drive voltage, for a second sub-pixel electrode electrically connected to the first com-line, according to the first com-voltage signal and the voltage adjustment transmitted by the data line; and deriving a third drive voltage, for a third sub-pixel electrode electrically connected to the second com-line, according to the second com-voltage signal and the voltage adjustment transmitted by the data line;

wherein the first drive voltage, the second drive voltage and the third drive voltage are different to each other.

2. The method as claimed in claim 1, wherein each of the first com-voltage signal and the second com-voltage signal is variable in every duty cycle.

3. The method as claimed in claim 2, wherein each of the first com-voltage signal and the second com-voltage signal has a phase and an amplitude, in which at least one of the phase and amplitude of the first com-voltage signal substantially differs from at least one of the phase and amplitude of the second com-voltage signal, respectively.

4. A pixel structure, comprising:

a data line configured to transmit a voltage adjustment;

a first com-line configured to transmit a first com-voltage signal;

a second com-line configured to transmit a second com-voltage signal;

a first sub-pixel electrode applied with a first drive voltage, wherein the first sub-pixel electrode is electrically connected to the first com-line and the second com-line, and the first drive voltage is derived according to the first com-voltage signal, the second com-voltage signal and the voltage adjustment transmitted by the data line;

a second sub-pixel electrode applied with a second drive voltage, wherein the second sub-pixel electrode is electrically connected to the first com-line, and the second drive voltage is derived by the first com-voltage signal and the voltage adjustment transmitted by the data line; and a third sub-pixel electrode applied with a third drive voltage, wherein the third sub-pixel electrode is electrically connected to the second com-line, and the third drive voltage is derived by the second com-voltage signal and the voltage adjustment transmitted by the data line;

wherein the first drive voltage, the second drive voltage and the third drive voltage are different to each other.

5. The pixel structure as claimed in claim 4, further comprising:

a first thin-film transistor (TFT) electronically connected to the first sub-pixel electrode;

a second TFT electronically connected to the second sub-pixel electrode; and a third TFT electronically connected to the third sub-pixel electrode.

6. The pixel structure as claimed in claim 4, wherein each of the first com-voltage signal and the second com-voltage signal is variable in every duty cycle.

7. The pixel structure as claimed in claim 6, each of the first com-voltage signal and the second com-voltage signal has a phase and an amplitude, in which at least one of the phase and amplitude of the first com-voltage signal substantially differs from at least one of the phase and amplitude of the second com-voltage signal, respectively.

8. The pixel structure as claimed in claim 4, wherein the pixel structure is adapted for used in a liquid crystal display (LCD).

* * * * *